United States Patent [19]

Crochet et al.

[11] Patent Number: 4,755,825

[45] Date of Patent: Jul. 5, 1988

[54] CONICAL SCAN PROCESS IN A RADAR ANTENNA, RADAR ANTENNA IMPLEMENTING SUCH A PROCESS AND USE OF SUCH AN ANTENNA IN A TRACKING RADAR

[75] Inventors: Pierre Crochet; Francois Gautier, both of Paris, France

[73] Assignee: Thomson CSF, Paris, France

[21] Appl. No.: 500,173

[22] Filed: Jun. 3, 1983

[30] Foreign Application Priority Data

Jun. 8, 1982 [FR] France ..... 82 09960

[51] Int. Cl.[4] ..... H01Q 3/00

[52] U.S. Cl. ..... 343/757; 343/763

[58] Field of Search ..... 343/425, 757, 759, 763

[56] References Cited

U.S. PATENT DOCUMENTS 2,643,338 6/1953 Brady ..... 343/763
2,759,182 8/1955 Chaffee .
3,009,152 11/1961 Gregory et al. .
3,071,770 1/1963 Wilkes .
3,081,048 3/1963 Lapham .
3,898,668 8/1975 Evans et al. ..... 343/759
4,188,632 2/1980 Knox .

FOREIGN PATENT DOCUMENTS 1287314 2/1962 France .
2466108 9/1980 France .

*Primary Examiner*—Theodore M. Blum
*Attorney, Agent, or Firm*—Cushman, Darby & Cushman

[57] ABSTRACT

The present invention relates to a conical scanning process in a radar antenna.

The antenna comprises a principal parabolic reflector (1) and a primary rear-feed source (2) fed by a circular waveguide (3) and displaced with respect to the focus of the parabolic reflector (1). The conical scanning is produced by the rotary movement of the parabolic reflector (1) about the source (2), the said source (2) and the circular guide (3) remaining fixed.

The present invention is applicable to tracking radars operating in the millimeter waveband.

3 Claims, 2 Drawing Sheets

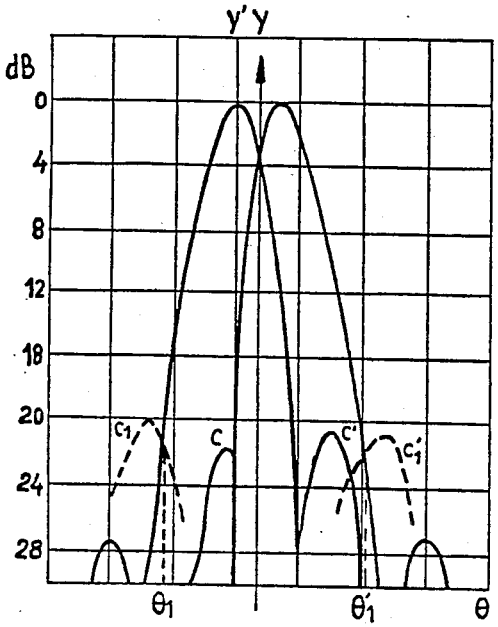
FIG_1
FIG_2 (PRIOR ART)
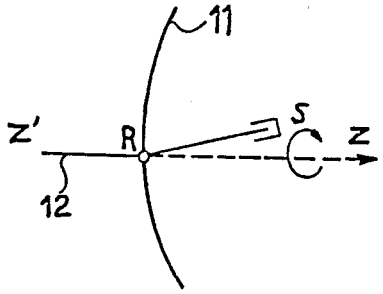
FIG_3
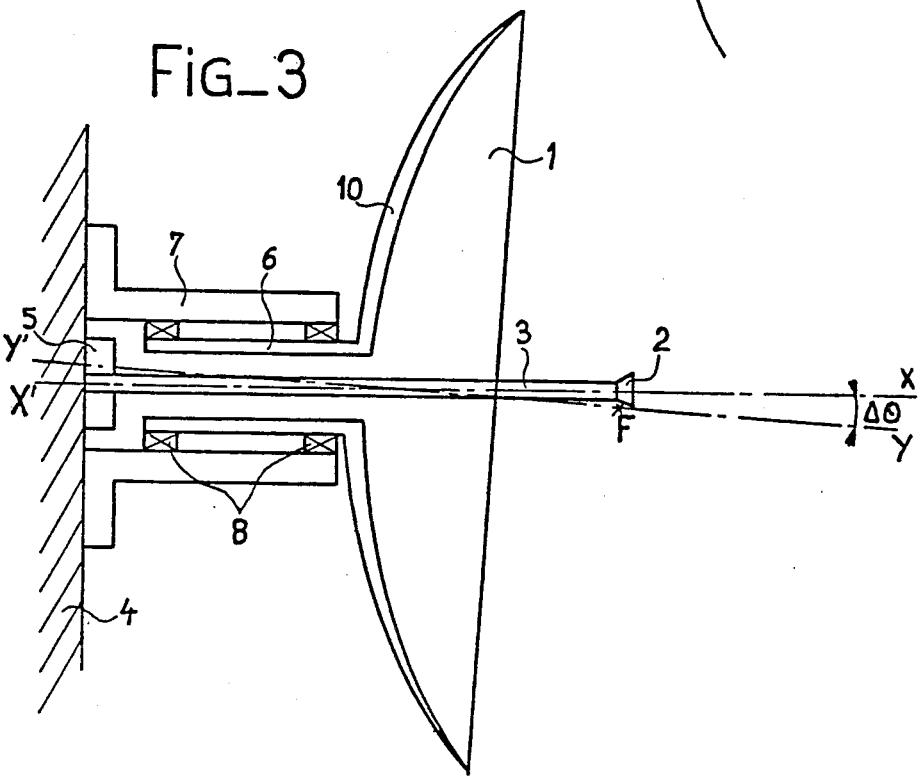

FIG_4-A
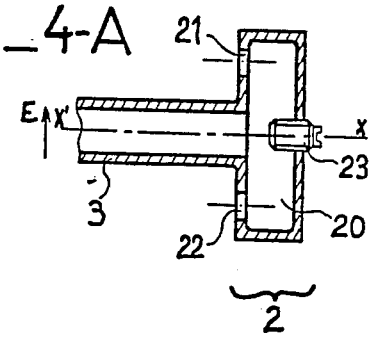
FIG_4-B
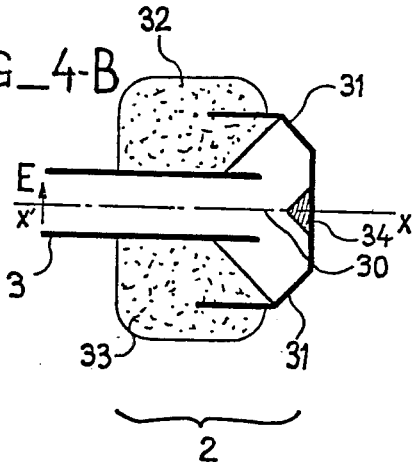
FIG_5
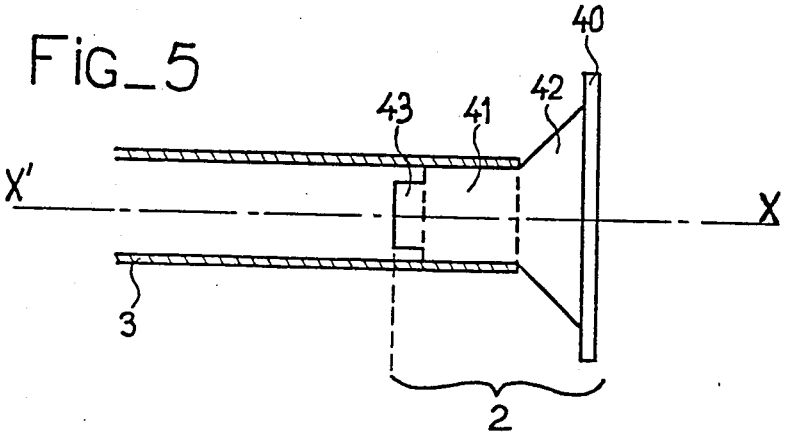

CONICAL SCAN PROCESS IN A RADAR ANTENNA, RADAR ANTENNA IMPLEMENTING SUCH A PROCESS AND USE OF SUCH AN ANTENNA IN A TRACKING RADAR

The present invention relates to a conical scan process in a radar antenna, a radar antenna implementing such a process and the use of such an antenna in a tracking radar.

In a tracking radar, it is necessary to obtain the direction and distance of a target at all times whilst maintaining it aimed automatically at the target.

A tracking radar must therefore be fed with signals which make it possible to produce elevation and bearing error voltages, intended to control servo-mechanisms which keep the antenna aimed at the target.

Such signals may be, for example, supplied by an antenna which makes it possible to provide a conical scanning of the radiated beam. Such an antenna is called "scanning antenna".

There is also a need to operate at very high frequencies in the millimeter waveband, with a beam rotating at high speed, of the order of several thousand rotations per minute. Such a speed of rotation can only be obtained provided there is no rotating joint or other unit such as a motor, a drive mechanism or supporting struts for the source, which placed below the antenna beam would interfere with its operation.

Conical scanning antennae fall into four principal types:

the first type of antenna, as shown in FIG. 2, uses a whipping movement of the source S around a swivel joint R placed at the vertex of a paraboloid 11, slightly behind the reflector.

The source S radiates towards the paraboloid 11.

The moments of inertia of the feed guide 12 and of the source S must be identical in all planes or otherwise the source describes an ellipse at high speeds of rotation. This whipping movement around a swivel joint demands a rotating joint in order to transmit power between the fixed and moving parts.

the second type uses, in a known manner, a Cassegrain optical system in which the mirror is driven by a motor located at the rear, which creates a significant shadow effect. This may be made acceptable for paraboloids of large diameter but not for small reflectors such as we consider for the invention. In this case the mirror may also be driven by a rotating sleeve placed around the feed guide, which makes it possible to place the motor behind the paraboloid. This results in an increase in the source dimensions which further degrades the performance of the antenna.

the third type uses a rotating source with fixed polarisation, radiating directly towards the reflector. A microwave rotating joint is connected to this source. This device, positioned in the antenna beam, presents a significant shadow effect. To avoid it this rotating source can illuminate, in place of a metallic reflector, a dielectric lens functioning as a transmitter. The symmetrical structure of the dielectric serves to focus the beam issuing from the source. Scanning is obtained by rotating the offset source about its own axis.

finally, the fourth type is called "tri-scanner".

It uses the fact that three obstacles situated at 120° in a circular guide excited in the $Te_{11}$ mode and radiating in phase, have a phase center which turns three times faster than the mechanical rotation of the assembly, and this on a circle of radius half that of the circle on which the phase centres of each of the obstacles are located.

These obstacles are generally longitudinal slots cut into the wall of the guide.

This type of source is particularly suitable in the case of a Cassegrain antenna.

The disadvantage of an antenna using such a source lies in embodying the three obstacles at high frequencies.

All antennae using the abovementioned solutions include a microwave rotating joint in order to ensure communication between the fixed and moving parts. Some of these solutions include supports in order to ensure the mechanical strength of the system, or else motors for driving the source. But such support elements or motors, placed in the antenna beam, cause its performance to be degraded.

The principle of the conical scanning and the main antennae of the "scanning" type referred-to above are described in Chapter 13 of the book by M. LEO THOUREL, "Les antennes", pages 393 to 409.

The present invention makes it possible to overcome the aforesaid disadvantages and concerns a conical scanning process making it possible to eliminate the use of a rotating joint in a radar antenna which therefore has a low loss.

A further object of the present invention is an antenna with no support elements or motors of the source.

A further object of the present invention is a conical scanning antenna of small dimensions and low weight which is able to rotate at a very high speed.

A further object of the present invention is an antenna whose primary source is of small dimensions, and which therefore has low loss due to shadow effect and little disturbed side lobes.

According to the invention the conical scanning in a radar antenna borne by support means, and comprising a principal parabolic reflector and a primary rear-feed source, fed by a circular waveguide and offset with respect to the focus of the parabolic reflector, is produced by the rotary motion of the parabolic reflector about its axis, the source and the circular feed guide of common axis aimed off with respect to the reflector axis remaining fixed and securely fastened to the antenna support means.

Other advantages and characteristics of the invention will become apparent when reading the detailed description which follows with reference to the attached figures which show:

FIG. 1, the typical pattern of a conical scanning antenna;

FIG. 2, the sectional view of a conical scanning antenna of the prior art;

FIG. 3, the sectional view of a conical scanning antenna according to the invention;

FIGS. 4A and 4B, the sectional view of two embodiments of the primary source used in the antenna of FIG. 3; and, FIG. 5, the sectional view of another preferred embodiment of the primary source used in the antenna of FIG. 3.

FIG. 1 shows the typical pattern of a conical scanning antenna.

The radiation pattern is modified by the offtarget aiming of the beam. Abberations modify the shape of the pattern and reduce the gain of the antenna. In FIG. 1 lobes, called coma lobes, (c) and (c') appear.

It is essential that these lobes stay within the envelope of the outmost positions of the principal lobe. If the coma lobes were the lobes (c1) and (c'1) drawn with dotted lines, false aiming directions $\theta_1$ and $\theta'_1$, could be obtained with such an antenna.

The need to reduce the aberrations, in the case of a paraboloid of focal distance f and diameter D, leads to the choice of a large ratio f/D. It will thus always be advantageous to use Cassegrain systems since in this case they behave as though one were using a paraboloid whose focal length is that of the equivalent paraboloid.

FIG. 2 shows the longitudinal-section of a scanning antenna of the first type of the prior art such as described in the introduction of the present application. As has already been mentioned, the source S of the rear-feed type radiating to the rear is driven by a whipping rotational movement about a swivel joint R placed at the vertex of the paraboloid 11 which is fixed with respect to the feed guide 12. Swivel joint R is constructed in such a way that the movement described by the source is a circle of axis Z'Z. In fact, at high speeds the source describes an ellipse. During the scanning therefore the various patterns do not intersect at the same position on Z'Z.

Thus it is necessary to make the moments of inertia in the two planes E and H equal. This disadvantage adds to those referred to earlier.

FIG. 3 shows the longitudinal-section of a conical scanning antenna according to the invention.

It comprises conventionnally a parabolic reflector 1 and a source 2. The source 2 is embodied in such a way as to radiate towards the paraboloid. Such a source is called "Rear-Feed".

Source 2 is fed from a circular waveguide 3 in which a $TE_{11}$ mode is propagated. This circular waveguide 3 is fastened at its other end to a fixed support 4 by means of a flange 5. Source 2 is thus fastened and centered with respect to the antenna support 4. The parabolic reflector 1 is placed in such a way that source 2 is displaced with respect to the focus F of the parabola 1: the axis Y'Y of parabola 1 subtends an angle with respect to the axis X'X of the circular waveguide 3 carrying the source 2.

According to a preferred non-limiting embodiment, the exterior structure 10 of the parabolic reflector 1 is extended to the rear in a direction opposite to the source 2, in order to form, around the circular waveguide 3, the rotor 6 of a drive motor (not shown) whose stator 7 is fixed to the support 4. Rotor 6 and stator 7 are concentric with the circular guide 3 and also with axis X'X. The friction produced during rotary motion of rotor 6 inside stator 7 is eliminated, for example by ball bearings 8 arranged between the two pieces 6 and 7 of the motor.

Such an embodiment makes it possible to save space and weight. Furthermore, the aiming angle errors due to the build-up of mechanical parts are reduced. But any other embodiment in which the parabolic reflector is aimed off with respect to the fixed source and turns around the latter does not depart from the bounds of the present invention.

From the aforegoing it is obvious that the conical scanning of the antenna beam is produced by the rotary motion of the parabolic reflector 1, driven by rotor 6 to which it is securely fastened, around the rear-feed source 2 with respect to which its axis is offset by $\Delta\theta$.

Source 2 of the antenna according to the invention shown by FIG. 3 must be of the rear-feed type in order to radiate towards the parabolic reflector 1 but its embodiment can vary according to the desired bandwidth.

It can be of the conventional type such as that shown in a non-limiting way by FIGS. 4 and 5 or produced in the preferred way as shown in FIG. 6.

FIGS. 4A and 4B show the longitudinal section of two non-limiting embodiments of the rear-feed source 2 used in the antenna of FIG. 3.

These two examples of a rear-feed source are known.

The source of FIG. 4A is selective. The plane of the section is plane E of the circular guide 3.

The energy delivered by the circular guide 3 divides into two in the end cavity 20 and radiation takes place towards the rear via two slots 21 and 22 which are sealed by sheets of dielectric material. Adjustment is provided by the screw 23 facing guide 3 on the other side of cavity 20. The power capability of this system is limited to 50 kW over 3.2 cm.

The source of FIG. 4B is wideband and makes it possible to transmit high powers of up to 250 kW.

The longitudinal section of source 2 is also provided through the plane E of the circular guide 3. The source, fed from the circular guide 3, consists of a rectangular guide 31 folded back towards the rear after the incident power has been divided into two at 30.

Maintenance of power output at altitude is ensured by pieces of Teflon® 32 and 33 closing the openings of guide 31 and contributing to the radiation of the source.

Adjustments of the assembly depends on the distance between the end of the central circular guide 3 and the wall of the rectangular guide 31 which faces it. This adjustment is made empirically using a metallic piece 34.

FIG. 5 shows a longitudinal section of another embodiment of the primary source used in the antenna according to the invention shown by FIG. 3. It is fed by the circular guide 3 which operates in $TE_{11}$ mode.

At its end, the circular guide 3 contains a cylindrical dielectric sleeve 41 which fills the whole of the volume of guide 3. This sleeve 41 extends to the exterior of guide 3 via a part 42 of dielectric material widening in the shape of a truncated cone of height approximately equal to $\lambda$, $\lambda$ being the wavelength in the guide 3, and having attached to its greater base a flat metallic reflector disc 40. The diameter of disc 40 is approximately 1.5 $\lambda$, $\lambda$ being the wavelength in the guide 3 containing the dielectric. Matching is effected by a quarter-wave transformer 43 fixed to the cylindrical sleeve 41 at the opposite end to that of the truncated cone piece 42.

The dielectric constant of the material of which the coupling 41 and the truncated cone piece 42 are made, is preferably close to 2.5 in order to obtain the optimum refraction of the waves issuing from the circular guide 3.

The cylindrical sleeve 41 makes it possible to centre the reflector disc 40 on axis X'X. The truncated cone part 42 provides an intermediate support piece between the cylindrical sleeve 41 and the disc 40.

The rear-feed source thus provided is a source whose frequency band is wide and greater than the bandwidth of the source shown by FIG. 4B.

The primary source of FIG. 5 operates in the following way:

A wave propagated by the circular guide 3 undergoes matching by the transformer 43, passes through cylindrical sleeve 41, is caused to diverge by truncated cone piece 42, and reaches reflector 40 which reflects it towards the principal reflector 1 of FIG. 3.

A conical scanning antenna, selective or wideband, with a high speed of rotation that can attain a speed of several thousand rotations per minute has thus been described.

A scanning antenna of this type is principally used in a tracking radar operating in the millimete wave band.

What is claimed is:

1. A conical scanning radar antenna adapted to be mounted on a support comprising:

a principal parabolic reflector;

a circular waveguide;

a rearward radiating primary source fed by said waveguide and offset with respect to the focus of the parabolic reflector and including a thin metallic reflector disc having the same axis as said waveguide and a piece of dielectric material fixing said disc to said waveguide at a distance substantially λ from the waveguide, λ being the wavelength of the guided signal, said piece being a cylindrical part inside said waveguide and having the same diameter as said waveguide and a truncated cone-shaped part of dielectric material of height λ with a base mounting said disc, said disc having a diameter of substantially 1.5 λ; and means for rotating said reflector about a rotation axis while said primary source and waveguide remain fixed including a drive motor with a stator adapted to be fixed to said support and a rotor inside said stator fixed to said reflector.

2. A scanning radar as in claim 1 wherein said rotating means includes ball bearings between said stator and rotor.

3. A scanning radar as in claim 1 including a quarter wave transformer on the cylindrical part, inside the waveguide and on the opposite side of the cylindrical part from said truncated piece.

* * * * *